US006176818B1

(12) United States Patent
Simmons, Jr. et al.

(10) Patent No.: US 6,176,818 B1
(45) Date of Patent: Jan. 23, 2001

(54) CUSHIONING CONVERSION MACHINE CUSHIONING CONVERSION METHOD AND METHOD OF ASSEMBLING A CUSHIONING CONVERSION MACHINE

(75) Inventors: James A. Simmons, Jr., Painesville; Richard O. Ratzel, Westlake, both of OH (US)

(73) Assignee: Ranpak Corp., Painesville Township., OH (US)

( * ) Notice: Under 35 U.S.C. 154(b), the term of this patent shall be extended for 0 days.

(21) Appl. No.: 09/209,678

(22) Filed: Dec. 11, 1998

Related U.S. Application Data

(63) Continuation-in-part of application No. 08/986,525, filed on Dec. 8, 1997, which is a continuation of application No. PCT/US96/09092, filed on Jun. 6, 1996, which is a continuation-in-part of application No. 08/478,256, filed on Jun. 7, 1995, now abandoned.

(60) Provisional application No. 60/069,393, filed on Dec. 12, 1997.

(51) Int. Cl.[7] ..... B31F 7/00

(52) U.S. Cl. ..... 493/346; 493/464; 493/967; 493/357

(58) Field of Search ..... 493/340, 464, 493/357, 967, 346

(56) References Cited

U.S. PATENT DOCUMENTS

| | | |
|---|---|---|
| 1,569,569 | 1/1926 | Pels . |
| 1,571,594 | 2/1926 | Lorenz . |
| 1,958,132 | 5/1934 | Davis . |
| 2,101,170 | 12/1937 | Engel . |
| 2,208,966 | 7/1940 | Eickman . |
| 2,494,413 | 1/1950 | Slettengren . |
| 2,569,589 | 10/1951 | Trissell . |
| 2,882,802 | 4/1959 | Walker . |
| 3,137,189 | 6/1964 | Raskin . |
| 3,466,959 | 9/1969 | Wharton . |
| 3,509,797 | 5/1970 | Johnson . |
| 3,524,301 | 8/1970 | Zimmerman . |
| 3,583,295 | 6/1971 | Elder . |
| 3,603,216 | 9/1971 | Johnson . |
| 3,613,522 | 10/1971 | Johnson . |

(List continued on next page.)

FOREIGN PATENT DOCUMENTS

| | | |
|---|---|---|
| 274188 | 12/1989 | (DD) . |
| 529457 | 3/1993 | (EP) . |
| 934766 | 5/1994 | (FI) . |
| 494645 | 10/1938 | (GB) . |
| 638877 | 6/1950 | (GB) . |
| 736469 | 9/1955 | (GB) . |
| WO96/40492 | 12/1996 | (WO) . |

* cited by examiner

*Primary Examiner*—Stephen F. Gerrity
*Assistant Examiner*—Sam Tawfik
(74) *Attorney, Agent, or Firm*—Renner, Otto, Boissella, Sklar LLP

(57) ABSTRACT

A cushioning conversion machine (20) including conversion assemblies (24) which convert a sheet stock material into a relatively low density cushioning product. The conversion assemblies (24) include a feed/cut assembly (26) having a feed device (100), a cut device (200), and a drive device (300). The drive device (300) is operable in two opposite directions and alternately drives the feed device (100) and the cut device (200). Clutch (134) and/or clutch (234) are provided which allow reverse operation of the feed device (100) and/or the cut device (200). A brake (238) prevents inadvertent movement of the moving components (220, 222) of the cut device (200). The power transmission from the drive device (300) to the feed device (100) and the cut device (200) includes a gear train (136, 236, 306) . These and other features of the feed/cut assembly (26) improve operating efficiency and/or simplify assembly procedures.

33 Claims, 8 Drawing Sheets

U.S. PATENT DOCUMENTS

| | | | |
|---|---|---|---|
| 3,645,157 | 2/1972 | DiGiullo . | |
| 3,650,877 | 3/1972 | Johnson . | |
| 3,655,500 | 4/1972 | Johnson . | |
| 3,672,252 | 6/1972 | Symonds . | |
| 3,695,133 | 10/1972 | Finke . | |
| 3,710,667 | 1/1973 | Kluger . | |
| 3,735,445 | 5/1973 | Jurcak . | |
| 3,738,212 | 6/1973 | Goodale . | |
| 3,799,039 | 3/1974 | Johnson . | |
| 3,817,139 | 6/1974 | Desai et al. . | |
| 3,941,021 | 3/1976 | Meinholdt . | |
| 4,026,198 | 5/1977 | Ottaviano . | |
| 4,047,811 | 9/1977 | Allis . | |
| 4,073,375 | 2/1978 | Hart et al. . | |
| 4,085,662 | 4/1978 | Ottaviano . | |
| 4,109,040 | 8/1978 | Ottaviano . | |
| 4,188,257 | 2/1980 | Kirkpatrick . | |
| 4,237,776 | 12/1980 | Ottaviano . | |
| 4,367,666 | 1/1983 | Toth . | |
| 4,410,315 | 10/1983 | Frye . | |
| 4,510,841 | 4/1985 | Farran . | |
| 4,557,716 | 12/1985 | Ottaviano . | |
| 4,619,635 | 10/1986 | Ottaviano . | |
| 4,650,456 | 3/1987 | Armington . | |
| 4,699,609 | 10/1987 | Komaransky et al. . | |
| 4,717,613 | 1/1988 | Ottavino . | |
| 4,726,260 | 2/1988 | Loverenich . | |
| 4,750,896 | 6/1988 | Komaransky et al. . | |
| 4,839,210 | 6/1989 | Komaransky et al. . | |
| 4,884,999 | 12/1989 | Baldacci . | |
| 4,912,910 | 4/1990 | Lowe et al. . | |
| 4,937,131 | 6/1990 | Baldacci . | |
| 4,968,291 | 11/1990 | Baldacci et al. . | |
| 5,042,345 | 8/1991 | Hawkins et al. . | |
| 5,123,889 | 6/1992 | Armington et al. . | |
| 5,149,075 | 9/1992 | Crowley et al. . | |
| 5,188,581 | 2/1993 | Baldacci . | |
| 5,203,761 | 4/1993 | Reichental et al. . | |
| 5,292,238 | 3/1994 | Michalak . | |
| 5,322,477 | 6/1994 | Armington et al. . | |
| 5,552,923 | 9/1996 | Min | 359/224 |
| 5,558,923 | 9/1996 | Vesamaa . | |
| 5,593,376 * | 1/1997 | Armington et al. | 493/464 |
| 5,607,383 * | 3/1997 | Armington et al. | 493/464 |
| 5,656,008 | 8/1997 | Beierlorzer . | |
| 5,674,172 | 10/1997 | Armington et al. . | |
| 5,688,578 | 11/1997 | Goodrich . | |

CUSHIONING CONVERSION MACHINE CUSHIONING CONVERSION METHOD AND METHOD OF ASSEMBLING A CUSHIONING CONVERSION MACHINE

RELATED APPLICATIONS

This application is a continuation-in-part of U.S. application Ser. No. 08/986,525 filed Dec. 8, 1997 which is a continuation of International Application No. PCT/US96/09092 filed Jun. 6, 1996, which is a continuation-in-part of U.S. patent application Ser. No. 08/478,256 filed Jun. 7, 1995 abandoned. The entire disclosures of these commonly assigned earlier applications are hereby incorporated by reference. This application claims the benefit of U.S. Provisional Ser. No. 60/069,393 filed Dec. 12, 1997.

FIELD OF THE INVENTION

This invention relates generally as indicated to a cushioning conversion machine, a cushioning conversion method, and a method of assembling a cushioning conversion machine. More particularly, the invention relates to such machine and methods wherein the machine's conversion assemblies include a feed/cut assembly comprising a feed device, a cut device, and drive device.

BACKGROUND OF THE INVENTION

In the process of shipping an item from one location to another, a protective packaging material is typically placed in the shipping case, or box, to fill any voids and/or to cushion the item during the shipping process. Some conventional commonly used protective packaging materials are plastic foam peanuts and plastic bubble pack. While these conventional plastic materials seem to adequately perform as cushioning products, they are not without disadvantages. Perhaps the most serious drawback of plastic bubble wrap and/or plastic foam peanuts is their effect on our environment. Quite simply, these plastic packaging materials are not biodegradable and thus they cannot avoid further multiplying our planet's already critical waste disposal problems. The non-biodegradability of these packaging materials has become increasingly important in light of many industries adopting more progressive policies in terms of environmental responsibility.

These and other disadvantages of conventional plastic packaging materials has made paper protective packaging material a very popular alterative. Paper is biodegradable, recyclable and renewable; making it an environmentally responsible choice for conscientious industries. While paper in sheet form could possibly be used as a protective packaging material, it is usually preferable to convert the sheets of paper into a relatively low density pad-like cushioning dunnage product. This conversion may be accomplished by a cushioning conversion machine, such as those disclosed in U.S. Pat. Nos. 4,619,635; 4,699,609; 5,123,889; and 5,674,172. (These patents are assigned to the assignee of the present invention and their entire disclosures are hereby incorporated by reference.) These cushioning conversion machines each include a feed/cut assembly comprising a feed device and a cut device.

In the cushioning conversion machine disclosed in U.S. Pat. No. 4,619,635, the feed device is driven by a reversible electric motor and the cut device is driven by a pneumatic motor. The housing of the cushioning conversion machine includes an end panel or wall. The feed device and the electric motor are mounted to the upstream side of the end wall and the cut device and the pneumatic motor are mounted on the downstream side of this end wall.

In the cushioning conversion machine disclosed in U.S. Pat. No. 4,699,609, the feed device is driven by a reversible electric motor and the cut device is driven by a solenoid motor. The housing of the cushioning conversion machine includes an end panel or wall. The feed device and the reversible motor are mounted to the upstream side of the end wall and the cut device is mounted to the downstream side of the end wall. The solenoid motor is mounted to the upstream side of the end wall and includes a shaft which extends through the end wall to the cut device.

In the cushioning conversion machine disclosed in U.S. Pat. No. 5,123,889, the feed device is driven by a reversible electric motor and the cut device is driven by another electric motor. The housing includes a base plate or wall and an end plate or wall which extends perpendicularly from a downstream edge of the base plate. The feed device is mounted to an upstream side of the end wall and the cut device is mounted to the downstream side of this end wall. The motors are mounted to the base wall and a clutch is provided which, when engaged, operatively couples the cut device to the cut motor.

In the cushioning conversion machine disclosed in U.S. Pat. No. 5,674,172, the feed device is driven by an electrical motor and the cut device is manually driven by a handle. Such a feed/cut assembly is used in a machine having a housing which includes an end wall and side walls extending downstream therefrom. The feed device is mounted to the downstream side of the end wall, with its drive shaft being mounted between the side plates. The cut device includes two mounting members to which the other components of the cut device are mounted independently of the machine's housing and these mounting members are attached to and extend between the side walls. The electrical motor is mounted to one of the side plates and the handle is supported by the side plates.

These cushioning conversion machines have achieved considerable commercial success. Nevertheless, environmental and other concerns generally create a continuing need for further improvements and modifications of such machines. Some improvements specifically include the elimination of separate drives for the feed device and the cut device, the ability of the feed device and/or the cut device to be operated in reverse directions, the avoidance of inadvertent movement of the moving components of the cut device, a more assembly-friendly drive-feed-cut power transmission, and a simplification of assembly procedures to allow efficient and consistent mass production.

SUMMARY OF THE INVENTION

The present invention provides a cushioning conversion machine and related methodology characterized by various features including inter alia, a single drive device for both a feed device and a cut device, a reversible clutch arrangement for a feed device and/or a cut device, a brake to avoid inadvertent movement of a cut device, simplified power transmission between a drive device and a feed device and/or cut device, and/or uncomplicated assembly procedures.

More particularly, the present invention provides a cushioning conversion machine comprising conversion assemblies which convert a sheet stock material into a relatively low density cushioning product. The conversion assemblies include a feed/cut assembly comprising a feed device, a cut device, and a drive device which is operable in two opposite directions.

According to one aspect of the invention, the cut device comprises a severing mechanism having moving components which sever the stock material and a motion-supplying mechanism which supplies motion to the severing mechanism. The motion-supplying mechanism comprises a clutch which is coupled to the drive device and which, when engaged, provides motion to the severing mechanism in two opposite directions. In this manner the severing mechanism may be operated in reverse so that, for example, jams in the severing mechanism may be prevented or at least more easily cleared by reversing the motion of the severing mechanism. The clutch is preferably an electromagnetic clutch and the motion-supplying mechanism preferably includes a shaft which the clutch allows to be rotated in both a clockwise and a counterclockwise direction. The severing mechanism preferably comprises a reciprocating carriage on which a blade is mounted and the cut device preferably comprises a motion-transferring mechanism which changes the shaft's rotational motion to reciprocating motion for the carriage of the severing mechanism. Preferably, the motion-transferring mechanism of the cut device comprises a pair of crank arms coupled to opposite ends of the rotating shaft and opposite ends of the reciprocating carriage of the severing mechanism. This connection of the crank arms is believed to provide the best cutting action due to the non-flat three-dimensional nature of the cushioning product being cut.

According to another aspect of the invention, the feed device comprises a pulling mechanism which pulls the stock material and a motion-supplying mechanism which supplies motion to the pulling mechanism. The motion-supplying mechanism comprises a clutch which is operatively coupled to the drive device and which, when engaged, provides motion to the pulling mechanism in two opposite directions. In this manner, the motion of the pulling mechanism may be reversed whereby, for example, jams in the pulling mechanism may be prevented or at least more easily cleared. The clutch is preferably an electromagnetic clutch and the motion-supplying mechanism preferably comprises a shaft which the clutch allows to be rotated in both a clockwise and counterclockwise directions. The pulling mechanism preferably includes a pair of loosely meshed wheels and one of the wheels is fixedly mounted on the shaft of the motion-supplying mechanism.

According to another aspect of the invention, the cut device includes a brake which, when in a braked condition, prevents movement of the moving components of the severing mechanism and which, when in a released condition, allows movement of the moving components of the severing mechanism. The brake is preferably biased, and more preferably mechanically biased, to the braked condition whereby inadvertent or unwanted movement of the severing mechanism is prevented even when the drive device is in a non-active state. An electromagnetic brake is preferred for this purpose.

According to another aspect of the invention, the motion-supplying mechanisms of the feed device and the cut device each have a rotating shaft with a feed gear and a cut gear, respectively, attached thereto. The drive device includes a drive gear that is meshed with both the feed gear and the cut gear to transfer rotational power to both the feed device and the cut device. Preferably, the gears are spur gears. In any event, such a gear arrangement is believed to greatly simplify the assembly, alignment, and/or adjustment of the power transmission when compared to, for example, a chain and sprocket arrangement.

According to another aspect of the invention, the cushioning conversion machine comprises a housing supporting at least some of the conversion assemblies. The feed device and the drive device are mounted to a first wall of the machine's housing, preferably an end wall, and the cut device is mounted to two different housing walls, preferably side walls extending downstream from the end wall. In a method of assembly according to the present invention, the feed device and the drive device are mounted to the first wall, the cut device is mounted to the two different walls, and the first wall and the two different walls are attached together. The cut device preferably includes two mounting members to which the other components of the cut device are mounted independent of the machine's housing and these two mounting members are preferably attached to and extend between the two different walls of the machine's housing. Preferably the feed device and the drive device are first mounted to the downstream surface of the first wall and the attaching step is performed prior to the step of mounting the cut device.

According to another aspect of the present invention, a cushioning conversion machine with any or all of the above-identified features is used to convert sheet stock material into a relatively low density cushioning product. The method comprises the steps of supplying the sheet stock material (preferably biodegradable, recyclable and made from a renewable resource, paper, multiply, thirty-pound Kraft, and/or twenty-seven inches wide); and using the cushioning conversion machine to convert the sheet stock material into the relatively low cushioning product. If the machine includes the above-described clutch arrangement, the converting step includes alternatively engaging the feed clutch and the cut clutch to pull and then cut the stock material. Also, the drive device may be activated in the reverse direction and then either the feed clutch or cut clutch engaged to operate the engaged device in a reverse direction. If the machine includes the above-described brake arrangement, the converting step includes releasing the brake to allow movement of the moving components of the severing mechanism.

The foregoing and other features of the invention are hereinafter fully described and particularly pointed out in the claims. The following description and annexed drawings setting forth in detail a certain illustrative embodiment of the invention, this being indicative, however, of but a few of the various way in which the principles of the invention may be employed.

DRAWINGS

DETAILED DESCRIPTION

Figure 1:
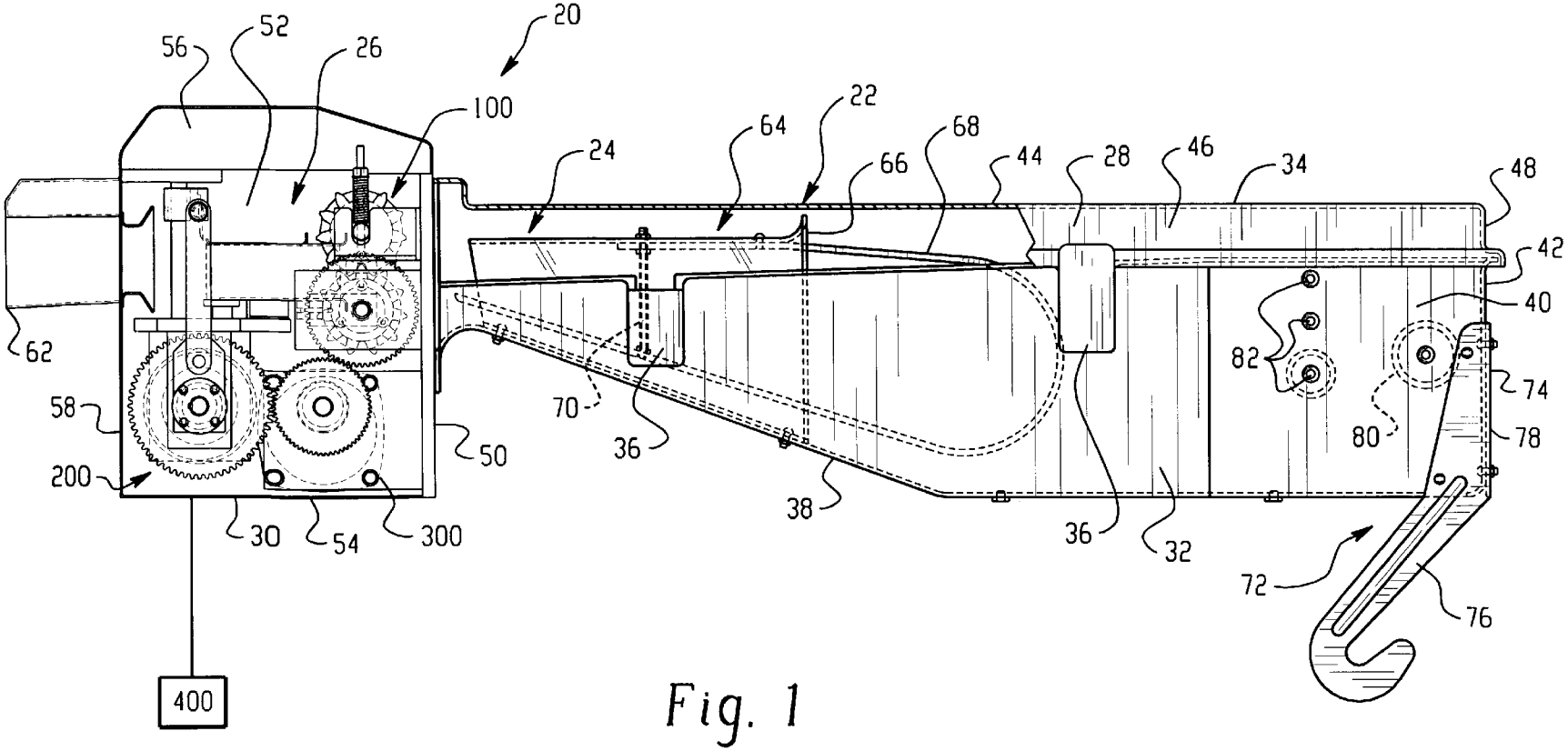
FIG. 1 is a side view of a cushioning conversion machine of the present invention, the machine being shown with some portions of its housing removed to reveal certain interior components.

Referring now to the drawings in detail, and initially to FIG. 1, a cushioning conversion machine 20 according to the present invention is shown. The cushioning conversion machine 20 includes a housing 22 and conversion assemblies 24. The housing 22 encloses and/or supports at least some of the conversion assemblies 24. The conversion assemblies 24 convert a sheet stock material into a relatively low density cushioning product. As is explained in more detail below, the conversion assemblies 24 include a feed/cut assembly 26 which includes a single drive device, allows reversibility, avoids inadvertent movement of certain cutting components, provides an assembly-friendly power transmission, and simplifies assembly procedures.

The stock material preferably consists of two or three superimposed webs or layers of biodegradable, recyclable and reusable thirty-pound Kraft paper rolled onto a hollow cylindrical tube. The preferred conversion assemblies 24 convert the stock material into a strip of cushioning product having lateral pillow-like portions separated by a central coined band and then cut this strip into sections of a desired length for use as a protective packaging material.

The illustrated cushioning conversion machine 20 has a modular construction whereby its housing 22 includes a first housing section 28 and a second housing section 30. A modular cushioning conversion machine construction of this general type, and the advantages thereof, are described in detail in U.S. Pat. No. 5,674,172. However, other modular and non-modular housing constructions are possible with, and contemplated by, the present invention.

The first housing section 28 is in the form of an outer or external shell, the geometry of which is best described by referring to the drawings. The housing section 28 is comprised of a base 32, a hinged cover 34, and latches 36 therebetween which allow the cover 34 to be opened and closed. The base 32 includes a bottom wall 38, side walls 40, and an upstream end wall 42. The cover 34 includes a top wall 44, side walls 46, and an upstream end wall 48. The base bottom wall 38 defines an inlet opening (not specifically shown in the drawings) for the stock material and the downstream edges of the base 32 and the cover 34 together define an outlet opening (not specifically shown in the drawings) for the stock material. The first housing section 28 is similar, if not the same, as the rear unit (also referred to as the shaping unit and/or the former) shown and described in U.S. Pat. No. 5,674,172.

The second housing section 30 has a generally box-like geometry and comprises an upstream end wall 50, side walls 52, a bottom wall 54, a top wall 56, and a downstream end wall 58. The upstream end wall 50 and the side walls 52 support as well as contribute to the enclosure of the feed/cut assembly 26. To this end, the walls 50 and 52 are made of suitable support material, such as aluminum plates. The remaining "enclosure" walls 54, 56, and 58 may be made of sheet metal and need not have the supporting qualities of the walls 50 and 52.

In any event, the second housing section 30 is preferably designed so that the supporting walls 50 and 52 may be assembled with the feed/cut assembly 26, and the remaining enclosing walls 54, 56 and 58 may be added at a later phase of the assembly process.

Figure 3:
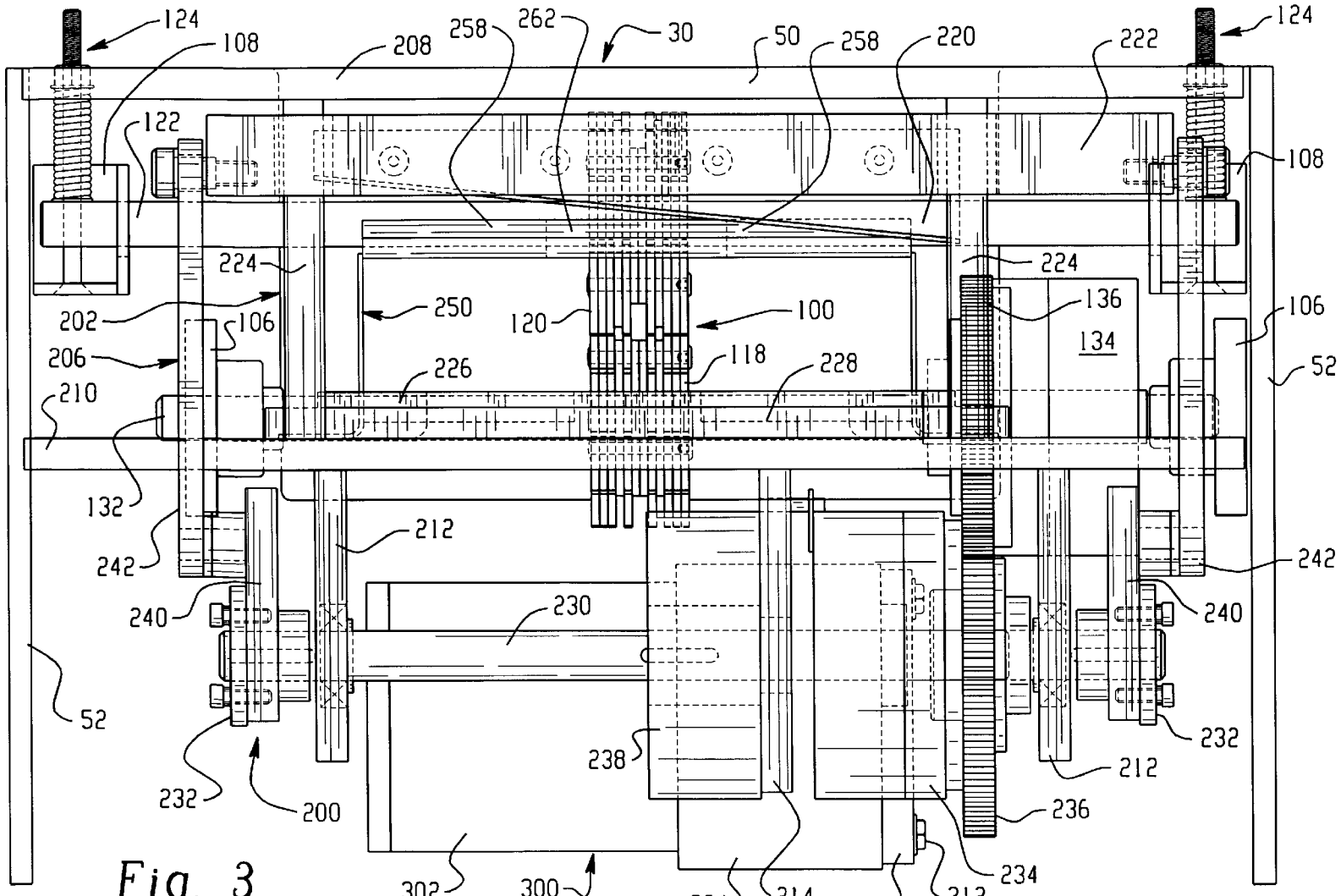
FIG. 3 is a downstream end view of the feed/cut assembly and certain relevant portions of the machine's housing.
Figure 4:
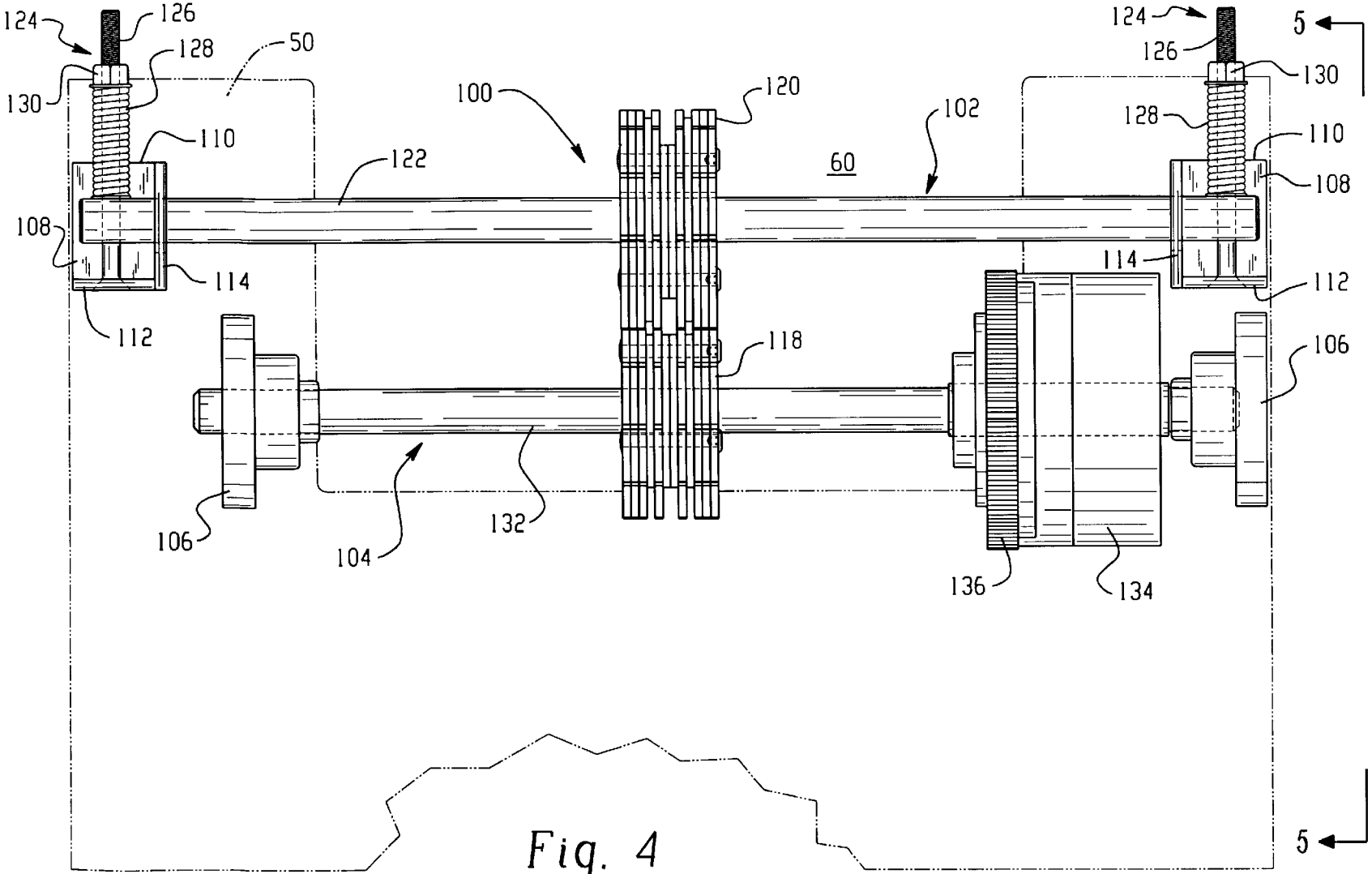
FIG. 4 is an upstream end view of a feed device of the feed/cut assembly, the feed device being shown mounted to a portion of the machine's housing and isolated from the other components of the feed/cut assembly.

As is best seen by referring momentarily to FIGS. 3 and 4, the upstream end wall 50 includes a large rectangular notch in its upper edge which defines the inlet opening 60 of the second housing section 30. Referring now back to FIG. 1, in the assembled cushioning conversion machine 20, the downstream edges of the base 32 and the cover 34 of the first housing section 28 extend around the inlet opening 60 (not specifically numbered in FIG. 1) thereby providing a passageway for the stock material from the first housing section 28 to the second housing section 30. The downstream end wall 58 includes a rectangular opening defining the outlet opening of the second housing section (the outlet opening is not specifically shown in the drawings). The second housing section 30 may also include a post-cutting passageway 62 which extends through and beyond the outlet opening.

In addition to the feed/cut assembly 26, the conversion assemblies 24 also include a former assembly 64 which is supported by and enclosed in the first housing section 28. The illustrated and preferred former assembly 64 includes a shaping chute 66, a former member 68, and an adjustment member 70, all of which are the same or similar to the analogous components disclosed in U.S. Pat. No. 5,674,172. As the stock material passes through the shaping chute 66, its lateral edges are turned or rolled inwardly so that as to form resilient pillow-like portions. The forming member 68 coacts with the shaping chute 66 to ensure proper shaping and forming of the paper, the forming member 68 being operative to guide the central portion of the stock material along the bottom wall of the shaping chute 66 for controlled inward rolling or folding. The adjustment member 70 allows, as needed, the adjustment of the spacing between the lower leg of the forming member 68 and the bottom wall of the shaping chute 66 to obtain proper shaping and forming of the stock material. In this manner, the former assembly 64 forms a strip having pillow-like portions and a central band therebetween.

The cushioning conversion machine 20 may further include a stock supply assembly 72 for supplying the stock material to the conversion assemblies 24. The illustrated stock supply assembly 72 includes a pair of laterally spaced apart mounts in the form of brackets 74 for supporting the stock roll. The brackets 74 each have a J-shape lower or distal portion 76 that forms an upwardly opening, preferably inclined, slot for nested receipt of the ends of a stock roll holder (such as a bar or holder) on which a stock roll may be centrally supported for rotation. The proximate or upper portion 78 of each stock roll bracket 74 is generally L-shape (in cross section) and configured for wrap-around attachment to the corners adjoining the side walls 40 to the upstream end wall 42 of the base 32 of the first housing unit 28. Similar brackets are described in more detail in U.S. Pat. No. 5,764,172.

The illustrated stock supply assembly 72 further comprises an entry guide 80 and separating members 82, preferably both in the form of the rollers described in U.S. Pat. No. 5,764,172. The entry guide or roller 80 provides a non-varying point of entry for the stock material into the forming assembly 64 regardless of the diameter of the roll of stock material. The separating members or rollers 82 separate the multiple plies of the stock material from one another. The rollers 80 and 82 are supported by and extend between upstream portions of the side walls 40 of the base 32 of the first housing section 28. The stock material passes from the stock roll supported by the brackets 74, through the inlet opening in the base's bottom wall 38, over the entry guide roller 80, and through the separating members or rollers 82 for separation of the respective plies.

The feed/cut assembly 26 comprises a feed device 100, a cut device 200, and a drive device 300, these devices being shown in FIG. 1 and also in more detail in FIGS. 2–9. As is explained in more detail below, these devices are designed and adapted to allow the drive device 300 to alternately drive the feed device 100 and the cut device 200, to allow reverse motion of the feed device 100 and cut device 200, to avoid inadvertent movement of the cut device 200, to simplify the power transmission between the drive device 300 and the feed device 100 and the cut device 200 and/or to uncomplicate the assembly of the feed/cut assembly 26.

Figure 5:
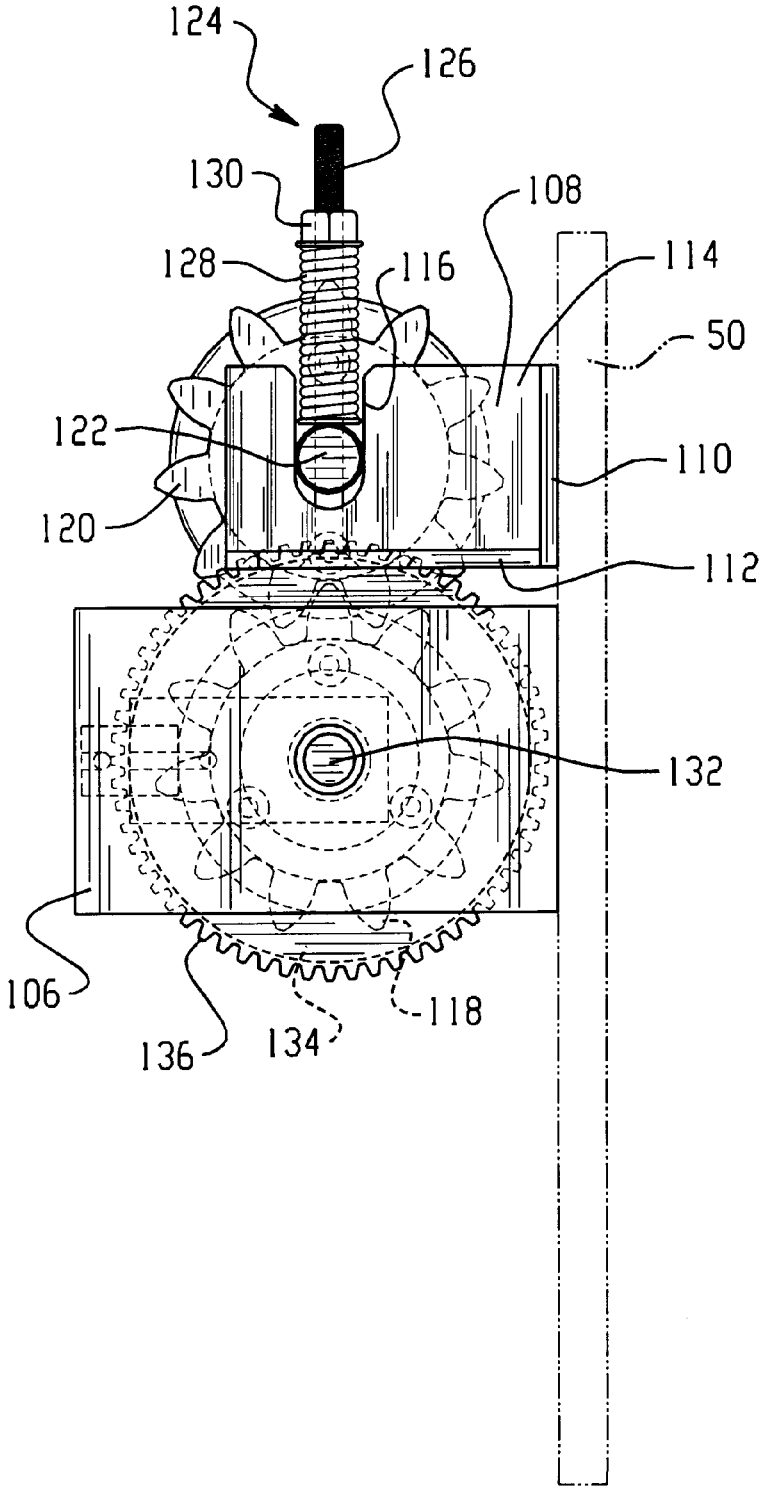
FIG. 5 is a side view of the isolated feed device as seen from line 5—5 in FIG. 4.

The feed device 100, shown with the rest of the cushioning conversion machine 20 in FIG. 1, is also shown with the rest of the feed/cut assembly 26 in FIGS. 2 and 3, and is again shown isolated from the other devices of the feed/cut assembly 26 in FIGS. 4 and 5. As is best seen by referring to the isolated view of FIGS. 4 and 5, the feed device 100 includes a pulling mechanism 102 and a motion-supplying mechanism 104. When certain components of the mechanism 102 are rotated by motion supplied by the mechanism 104, the stock material is pulled or fed through the machine 20.

The feed device 100 further comprises mounting members 106 and 108 which mount the pulling mechanism 102 and the motion-supplying mechanism 104 to the machine's housing 22 and more particularly to the upstream end wall 50 of the second housing section 30. (FIGS. 4 and 5.) The mounting members 106 are in the form of a pair of brackets having a generally rectangular plate-like geometry. (FIG. 4.) One edge of each of the rectangular brackets 106 is mounted to the downstream surface of the end wall 50 and extends downstream therefrom. (FIG. 5.) The mounting members or brackets 106 are non-symmetrically positioned outward from the vertical edges defining the inlet opening 60 and equally positioned slightly upward from the horizontal edges defining the bottom of the inlet opening 60. (FIG. 4.) Although not specifically numbered in the drawings, the brackets 106 each include an opening for accommodating the ends of a rotating shaft. (FIG. 4.)

The mounting members 108 are also in the form of a pair of brackets and these brackets each have a three-sided box-like geometry. Specifically, each mounting member or bracket 108 includes rectangular plate-like panels 110, 112, and 114. (FIGS. 4 and 5.) The end panel 110 is mounted to the downstream surface of the housing end wall 50 and the bottom panel 112 and the side panel 114 extend downstream therefrom. (FIG. 5.) The brackets 108 are positioned equally above the mounting bracket 106 and are symmetrically positioned relative to the inlet opening 60, with one side of each of the end panels 110 being substantially flush with the side edge of the housing wall 50. (FIG. 4.) The panel 114 includes an open-topped slot 116 for accommodating the ends of a non-rotating shaft, particularly shaft 122 introduced below. (FIG. 5.) Although not specifically shown in the drawings, the bottom panel 112 includes an opening for anchoring the flat head of a bolt-like component, particularly tie member 126 introduced below. (FIG. 4.)

The pulling mechanism 102 comprises rotatable, generally loosely meshed gear-like members or wheels 118 and 120. (FIGS. 4 and 5.) The wheels 118 and 120 engage and move the stock material through the machine 20, such as by pulling the stock material from the stock supply assembly 72, through the former assembly 64 to form the strip of cushioning product and then pushing the strip through the cut device 200 and through the post-cutting passageway 62. The wheels 118 and 120 may also connect, by stitching or coining, the stock material together to maintain the desired three-dimensional shape of the cushioning strip. In the preferred and illustrated embodiment, the wheels 118 and 120 engage the central band between the pillow-like portions of the strip formed by former assembly 64 to pull the stock material through the machine and connect the stock material along this central band.

The wheels 118 and 120 may be of the type disclosed in commonly assigned U.S. Pat. No. 4,968,291 which coin and perforate the central band. Alternatively and as illustrated, the wheels 118 and 120 are of the type disclosed in commonly assigned application set forth in International Publication Number WO 96/40493, the entire disclosure of which is hereby incorporated by reference. Such wheels are rotatable stitching members with mating projections and recesses and which are preferably formed by a plurality of interconnected flat disc members stacked side-by-side.

The pulling mechanism 102 includes a non-rotating shaft 122 on which the wheel 120 is rotatably mounted. As is explained in more detail below, the wheel 118 is fixedly attached to a rotating shaft of the motion-supplying mechanism 104 whereby rotational motion of the wheel 118 will be transferred to intermeshed wheel 120. (FIGS. 4 and 5.) The ends of the shaft 122 extend through the slot 116 in the side panel 114 of each of the brackets 108 thereby mounting the shaft 122 and the wheel 120 to the machine's, housing 22. (FIG. 5.) Although not specifically numbered in the drawings, the ends of the shaft 122 each include a diametrical opening for accommodating a bolt-like component, particularly tie member 126 introduced below. (FIG. 4.)

The pulling mechanism 102 further includes a biasing system 124 which resiliently urges the wheel 120 towards the wheel 118 to hold the wheels in a meshed relationship with the stock material therebetween. In the illustrated embodiment, the biasing system 124 includes a pair of bolt-like tie members 126. The tie members 126 each have an enlarged head (shown but not specifically numbered in the drawings) which extend through the openings in, and are anchored to, the bottom panels 112 of the respective brackets 108. (FIG. 4.) The tie members 126 each extends upward through the diametrical opening in the ends of the shaft 122. A coil spring 128 is positioned around the tie member 126 above the shaft 122 and a stop 130 is threaded to the top of the tie member 126. In this manner, the pre-loaded shaft 122 is free for limited flotation within the slot 116. The stop 130 may be advanced or retracted to change the compression of the spring 128 to adjust the squeeze pressure applied by the wheels 118 and 120. (FIGS. 4 and 5.)

The motion-supplying mechanism 104 comprises a rotating shaft 132, a clutch 134, and a gear 136. (FIGS. 4 and 5.) The ends of the rotating shaft 132 extend through the bearing openings in the mounting members or brackets 106 whereby the shaft 132 is rotatably mounted to the machine's housing 22 and more particularly to the end wall 50 of the second housing section 30. The wheel 118 of the pulling mechanism 102 is non-rotatably attached to a central portion of the shaft 132. Thus, as the shaft 132 is rotated, the wheel 118 is likewise rotated.

The shaft 132 is operatively coupled to the clutch 134 when the clutch is engaged. The clutch 134 is of a type capable of permitting rotation of the shaft 132 and thus the wheel 118 in both a clockwise and counterclockwise direction. In this manner, the pulling mechanism 102 may be operated in reverse to, for example, eliminate or prevent a jam situation. In the illustrated and preferred embodiment, the clutch 134 is an electromagnetic clutch that is engaged by the energization of a magnetic coil which, for example, attracts a set of discs, and establishes the operable connection between the clutch 134 and the shaft 132. A suitable clutch is manufactured by Inertia Dynamics of Collinsville Conn., under part number BSL42.

The gear 136, preferably a spur gear, is coupled to the clutch 134 and also to the drive device 300. When the drive device 300 is activated, the spur gear 136 is rotated, which in turn rotates certain interior components of the clutch 134. When the clutch 134 is engaged, the shaft 132 will also be rotated thereby rotating the wheel 118 which in turn rotates wheel 120 to pull the stock material through the machine 20. Thus, the gear 136 remains in rotation during operation of the machine 20, with the pulling mechanism 102 being activated/deactived by the engagement/disengagement of the clutch 134. The cut device 200, shown with the rest of the cushioning conversion machine 20 in FIG. 1, is also shown with the rest of the feed/cut assembly 26 in FIGS. 2 and 3, and is again shown isolated from the other devices of the feed/cut assembly 26 in FIGS. 6 and 7. As is best seen by referring to the isolated views of FIGS. 6 and 7, the cut device 200 includes a severing mechansim 202, a motion-supplying mechanism 204, and a motion-transferring mechanism 206. The mechanism 204 supplies rotational motion which is changed or transmitted as reciprocating motion by the mechanism 206 to the severing mechanism 202. When certain components of the mechanism 202 are moved in a linear or reciprocating fashion, the strip of cushioning product is severed or cut into sections.

Figure 2:
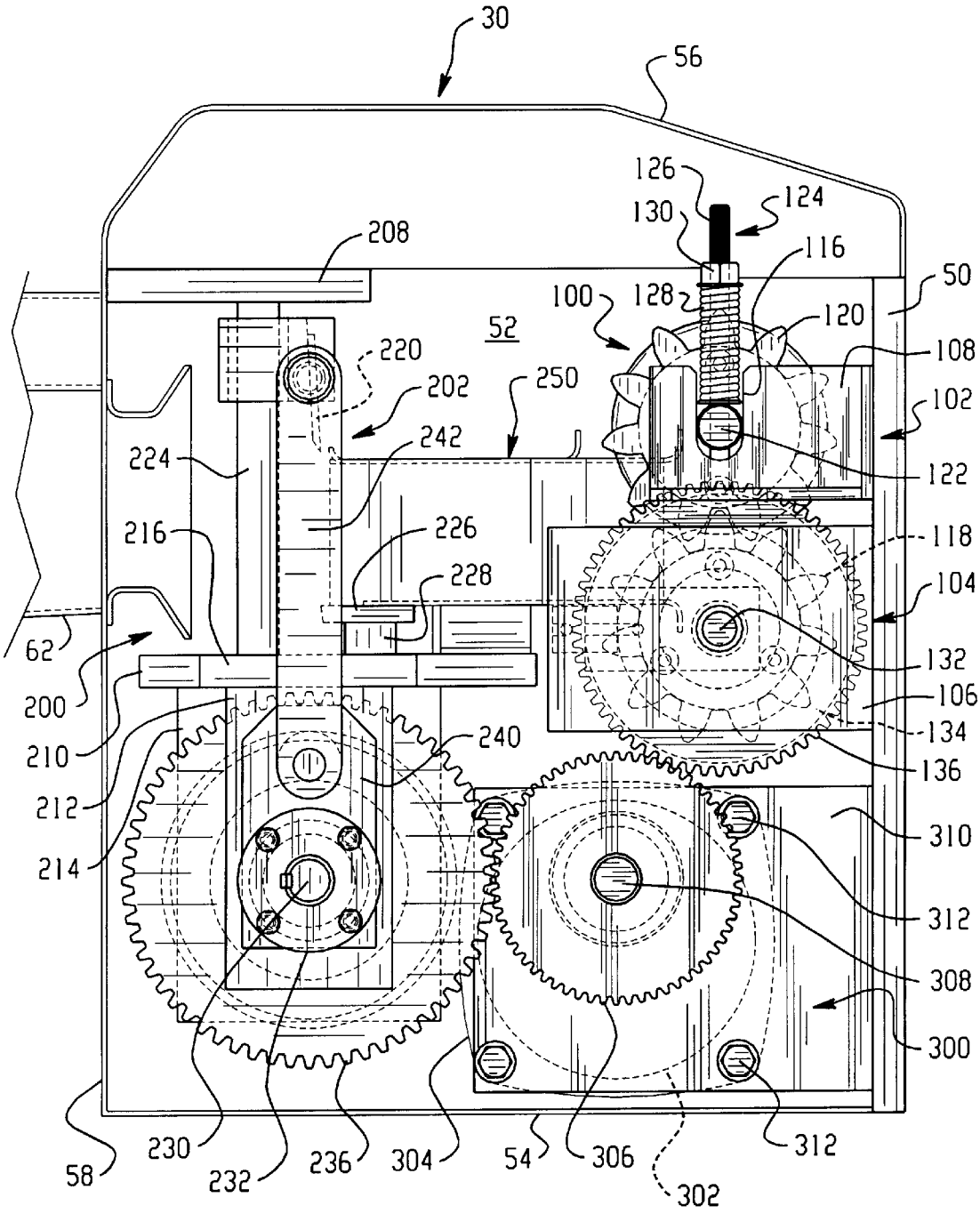
FIG. 2 is an enlarged view of a feed/cut assembly of the cushioning conversion machine and certain relevant portions of the machine's housing, the feed/cut assembly including a feed device, a cut device, and a drive device.
Figure 6:
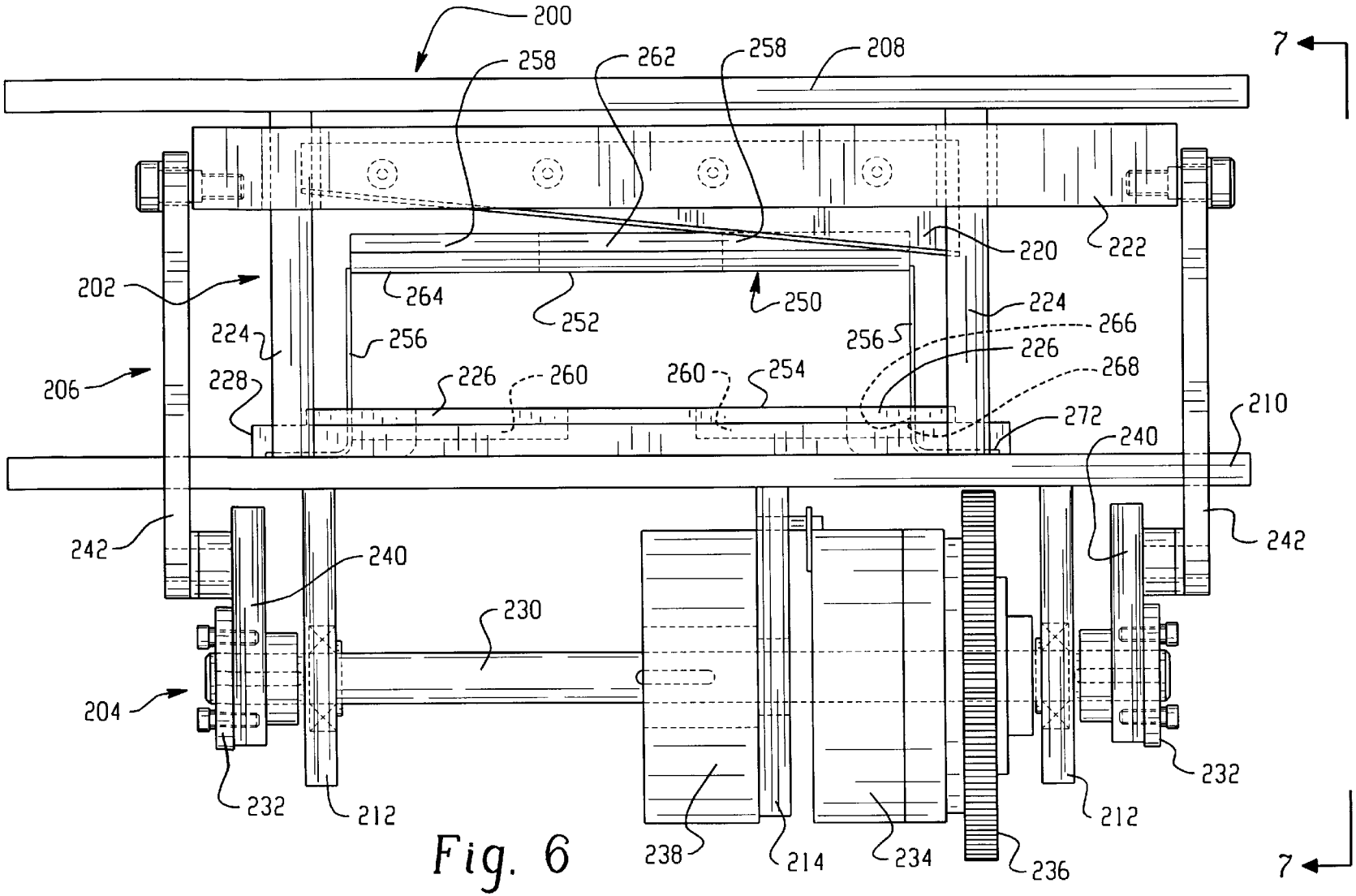
FIG. 6 is a downstream end view of a cut device of the feed/cut assembly, the cut device being shown isolated from the other components of the feed/cut assembly.
Figure 7:
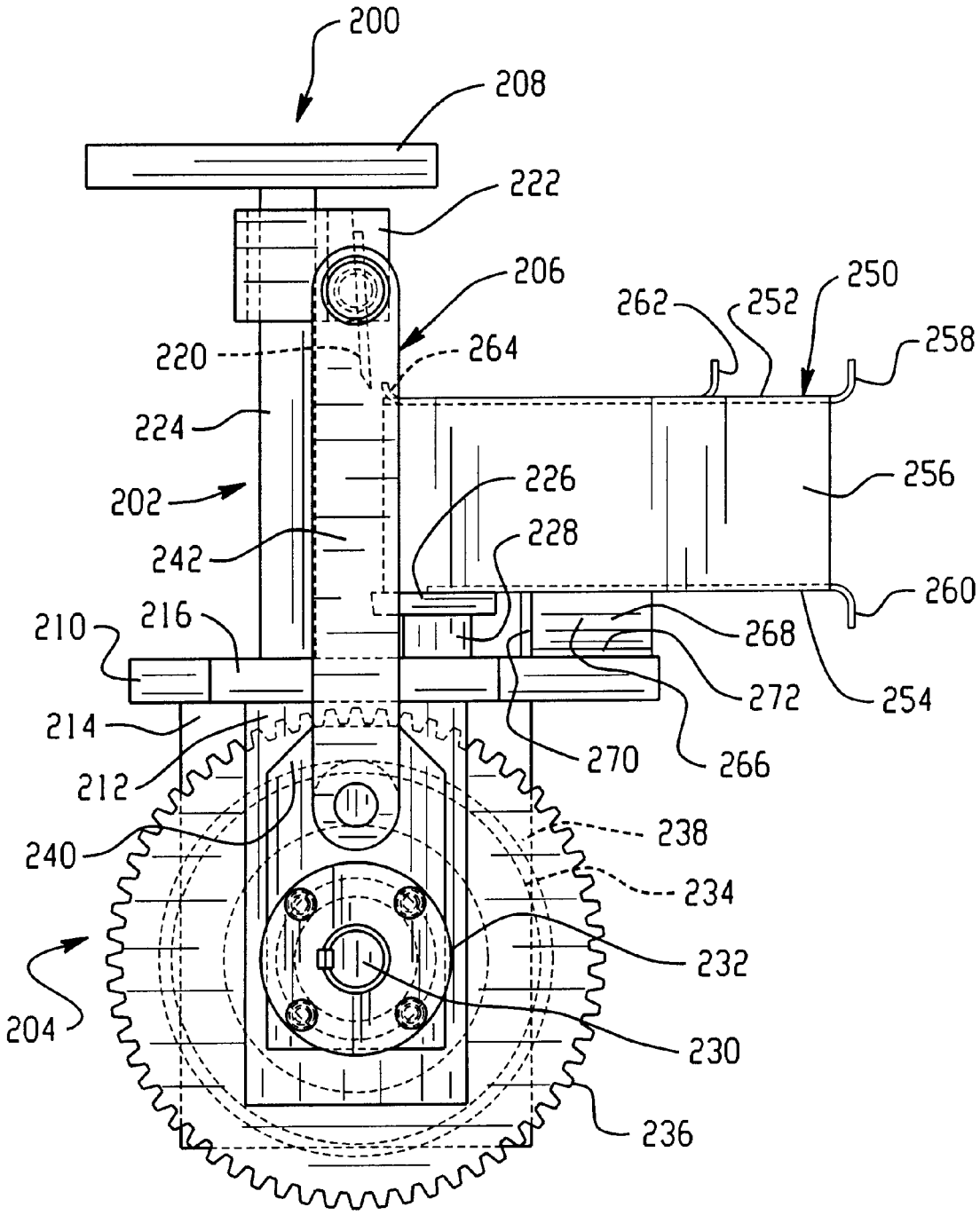
FIG. 7 is a side view of the isolated cut device, as seen from line 7—7 in FIG. 6.

The cut device 200 further comprises mounting members 208, 210, 212 and 214. (FIGS. 6 and 7.) These members mount the severing mechanism 202, the motion-supplying mechanism 204, and the motion-transferring mechanism 206 to the machine's housing 22 and more particularly to the side walls 52 of the second housing section 30. (FIGS. 2 and 3.)

The mounting member 208 is in the form of a horizontal platform (FIGS. 6 and 7) that extends between the uppermost and downstream most portions of the side walls 52. (FIGS. 2 and 3.) The mounting member 210 is also in the form of a horizontal platform (FIGS. 6 and 7) that extends between the side walls 52. (FIGS. 2 and 3.) The mounting platform 210 is at an approximately central level of the side walls 52, just beneath the level of the post-cutting passageway 62, slightly inset from the downstream edge of the side walls 52. (FIG. 2.) Slots 216, preferably openended, are provided in the opposite ends of the mounting platform 210 for accomodating certain components of the motion-transferring mechanism 206, specifically connecting rods 242 introduced below. (FIG. 7.)

The mounting members 212 are in the form of a pair of brackets having a rectangular plate-like geometry. (FIGS. 6 and 7.) The mounting members 212 are oriented parallel with the upstream-downstream direction and are attached to the mounting member or platform 210. (FIG. 6.) More particularly, the upper edges of the mounting members or brackets 212 are attached to the bottom surface of the mounting platform 210 and the brackets extend downwardly therefrom. (FIGS. 6 and 7.) The mounting members or brackets 212 are transversely positioned near the side edges of the platform 210 and are not symetrically positioned relative to the platform 210. (FIG. 6.) Although not specifically numbered in the drawings, the lower portion of the brackets 212 includes a central bearing opening to accomodate a rotating shaft, specifically shaft 230 introduced below. (FIGS. 6 and 7.)

The mounting member 214 is also in the form of a bracket having a rectangular plate-like geometry which is wider and longer than the mounting members or brackets 212. (FIG. 7.) The bracket 214 is also oriented parallel to the upstream-downstream direction and has its upper edge attached to, and extends downward from, the bottom surface of the mounting platform 210. (FIGS. 6 and 7.) The mounting member 214 is transversely positioned below an intermediate (but not central) portion of the mounting platform 210. (FIG. 6.) A central opening (shown but not specifically numbered in the drawings) is provided in the lower portion of the mounting member 214 to accomodate a rotating shaft, specifically shaft 230 introduced below. (FIG. 6.)

The severing mechanism 202 comprises a blade 220, a movable carriage 222, and a pair of guide rods 224. (FIGS. 6 and 7.) The carriage 222 has a bar-like geometry and the blade 220 is fixedly mounted thereto. The guide rods 224 extend vertically between, and are fixedly attached to, the mounting platforms 208 and 210 in a transversely symmetrical arrangement (FIG. 6) setting them just slightly inset relative to the sides of the inlet opening 60. (FIG. 3.) The guide rods 224 slidingly extend through non-symetrical vertical channels (shown but not specifically numbered in the drawings) in the carriage 222 whereby the carriage 222, and thus, the blade 220 are mounted for linear sliding movement on the guide rods 224. (FIGS. 6 and 7.)

The severing mechanism 202 may also comprise another blade 226 which coacts with the blade 220 to sever the strip of cushioning. In the illustrated embodiment, the blade 226 is stationarily positioned at the lower portion of the cutting zone. (FIGS. 6 and 7.) Specifically, the stationary blade 226 is fixedly mounted to the lower mounting platform 210 via a mounting step 228. The mounting step 228 is positioned just upstream of the guide rods 224 and elevates the stationary blade 226 slightly above the platform 210 so that the moving blade 220 may pass thereby during the severing stroke. (FIG. 7.)

The motion-supplying mechanim 204 comprises a rotating shaft 230, a pair of hubs 232, a clutch 234, a gear 236, and a brake 238. (FIGS. 6 and 7.) The rotating shaft 230 extends through the openings in the mounting members or plates 212 and 214 and is thus rotatably supported below the mounting platform 210. (FIGS. 6 and 7.) In this manner, when the mounting members or platforms 208 and 210 are attached to the side walls 52 of the second housing section 30, the shaft 230 will be rotatably mounted to the machine's housing 22. The clutch 234 is mounted on one side of the mounting plate 214 and the brake 238 is mounted to the other side of the mounting plate 214. (FIG. 6.)

The ends of the rotating shaft 230 extend beyond the outer mounting plates 212 and the hubs 232 are mounted thereon. (FIG. 6.) As is explained in more detail below, the hubs 232 coordinate with the motion-transferring mechanism 206 to transfer the rotational motion of the shaft 230 into linear motion for the severing mechanism 202. In this manner, as the shaft 230 is rotated, the carriage 222 slides up and down to allow the blades 220 and 226 to coact to cut the strip of cushioning product.

The rotating shaft 230 is operatively coupled to the clutch 234. The clutch 234 is of a type capable of permitting rotation of the shaft 230 in both a clockwise and counterclockwise direction. In this manner, the severing mechanism 202 may be operated in reverse to, for example, eliminate or prevent a jam situation. In the illustrated and preferred embodiment, the clutch 234 is an electromagnetic clutch that is engaged by the energization of a magnetic coil. A suitable clutch is manufactured by Inertia Dynamics of Collinsville Conn., under part number BSL42.

The gear 236, preferably a spur gear, is coupled to the clutch 234 and the drive device 300. When the drive device 300 is activated, the spur gear 236 is rotated, which in turn rotates the certain interior components of the clutch 234. When the clutch 234 is engaged with the shaft 230, the shaft 230 and the hubs 232 are rotated thereby and, via the motion-transferring mechanism 206, move the carriage 222, and thus the blade 220, to perform a cutting stroke.

The brake 238 is preferably an electromagnetic brake that is released by the energization of a magnetic coil. The brake 238 allows the cut device 200 to be stopped very quickly during operation as may be desired in a jam or other situation. The brake 238 is preferably biased to a braked or engaged condition by springs or other mechanical biasing means and the energization of the magnetic coil overcomes this bias to allow rotation of the shaft 230 and thus the movement of the blade 220. In this manner, the moving components of the cut device 200 are prevented from inadvertant or unwanted movement even when the drive device 300 is not being operated. A suitable brake is manufactured by Inertia Dynamics of Collinsville Conn., under part number SAB180.

The motion-transferring mechanism 206 comprise a pair of crank arms 240 and a pair of connecting rods 242. The crank arms 240 are each connected to a respective hub 232 whereby the rotate with the shaft 230. The connecting rods 242 are journaled at one end to the crank arms 240 and extend upward therefrom through the openings 216 in the mounting platform 210. The opposite ends of the connecting rods 242 are pivotally connected to respective ends of the carriage 222 to move the carriage 222 (and the blade 220 attached thereto) in a reciprocatory manner up and down on the guide rods 224. This connection arrangement is believed to provide the best cutting action due to the non-flat three-dimensional nature of the cushioning product.

When the drive device 300 is activated, the spur gear 236 is rotated, which in turn rotates the clutch 234. When the clutch 234 is engaged and the brake 238 is released, the shaft 230 will be rotated thereby rotating the hubs 232 and the crank arms 240. The crank arms 240 affect movement of the connecting rods 242 which in turn move the carriage 222 and the blade 220 attached thereto through a cutting stroke. Thus, the clutch 234 and the gear 236 remain in rotation during operation of the machine 20, with the severing mechanism 202 being activated/deactived by the engagement/disengagement of the clutch 234 and the releasing/braking of the brake 238.

The cut device 200 may also include a pre-cutting tunnel 250 through which the strip of cushioning product travels from the pulling mechanism 102 to the severing mechanism 202. The illustrated tunnel 250 includes a top wall 252, a bottom wall 254, and a pair of side walls 256. The top wall 252 and the bottom wall 254 each include a central slot or cut-out into their upstream ends to accomodate the wheels 118 and 120 of the pulling mechanism 102. (FIG. 2.) To guide the strip of cushioning product, outwardly flaring lips 258 and 260 are located at the upstream edges bordering the wheel-accomodating cut-outs of the top wall 252 and the bottom wall 254, respectively. (FIGS. 6 and 7.) The top wall 252 includes a similar lip 262 at the transverse edge of the cutout and a smaller less dramatic lip 264 at its downstream edge (FIGS. 6 and 7.) The tunnel 250 is mounted to the top surface of the mounting platform 210 by a pair of mounting spacers 266. The mounting spacers 266 each include a vertical section 268 extending downward from the side walls 256 (FIG. 6), another vertical section 270 extending perpendicularly inward from downstream edge of the vertical section 268 (FIG. 7), and a horizontal section 272 extending perpendicuarly outward from the vertical section 268 (FIG. 6).

Figure 8:
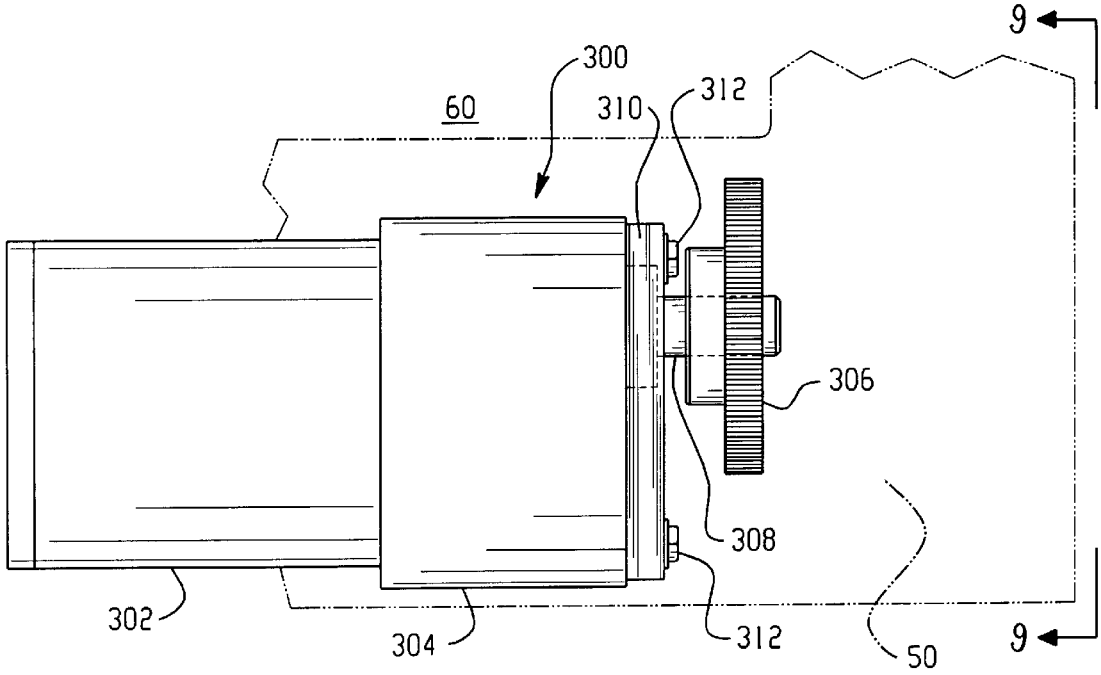
FIG. 8 is a downstream end view of a drive device of the feed/cut assembly, the drive device being shown mounted to a portion of the machine's housing and isolated from the other components of the feed/cut assembly.
Figure 9:
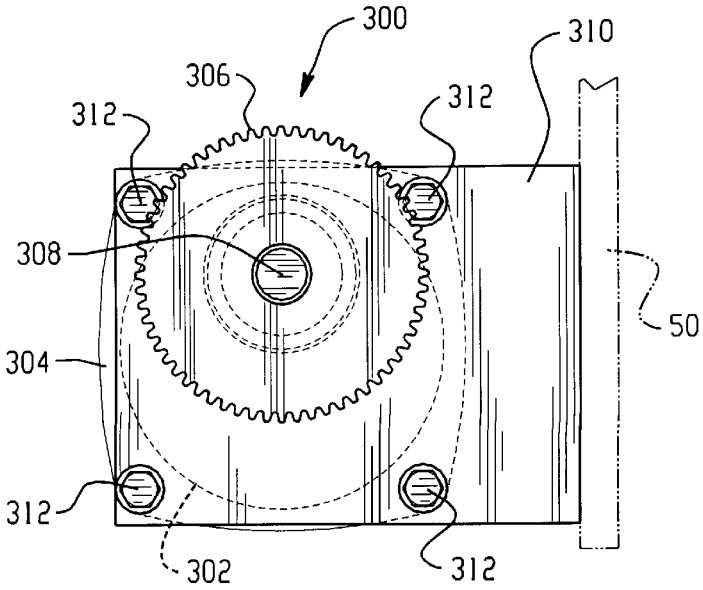
FIG. 9 is a side view of the isolated drive device, as seen from line 9—9 in FIG. 8.

The drive device 300, shown with the rest of the cushioning conversion machine 20 in FIG. 1, is also shown with the rest of the feed/cut assembly 26 in FIGS. 2 and 3, and is again shown isolated from the other devices of the feed/cut assembly 26 in FIGS. 8 and 9. As is best seen by referring to the isolated view of FIGS. 8 and 9, the drive device 300 comprises a motor 302, a speed reducer 304, and a gear 306. These components coordinate to provide rotational drive to the feed device 100 and the cut device 200.

The motor 302 is preferably an electric rotary motor which is also preferably reversible. A suitable motor is manufactured by Reliance Electric of Gallipolis Ohio under part number 1870145023. The speed reducer 304 is conventional and may not be necessary if the output speed and torque of the selected motor 302 is already appropriate and/or if certain gear train arrangements are employed. The output shaft 308 of the speed reducer 304 (or the motor 302 if a speed reducer is not used), is connected to the gear 306, which is preferably a spur gear. When the motor 302 is activated, the output shaft 308 is rotated thereby rotating the gear 306.

The gear 306 of the drive device 300 is directly meshed with both the gear 136 of the feed device 100 and the gear 236 of the cut device 200 (FIG. 2) whereby the gears 136 and 236 are rotated. In the illustrated gear train, the drive gear 306 is the smallest in diameter, the cut gear 236 is the largest in diameter, and the feed gear 136 is of an intermediate diameter. However, other gear sizes and arrangements, and gears other than spur gears, are possible with, and contemplated by, the present invention. In any event, such a gear arrangement in the power transmission between the drive device 300 and the feed device 100 and the cut device 200 is believed to greatly simplify the assembly, alignment and/or adjustment of the power transmission when compared to, for example, a chain and sprocket arrangement.

The motor 302 and the speed reducer 304 are mounted to the machine's housing 22, or more specifically the end wall 50 of the second housing section 30 by a mounting member 310. The mounting member 310 is in the form of a panel extending parallel to the upstream-downstream direction. The upstream edge of the mounting panel 310 is attached to the downstream side of the end wall 50.

The motor 302 and speed reducer 304 are mounted to the downstream portion of the mounting plate 310 via bolts 312 and extend inwardly therefrom. A bearing opening (shown but not specifically numbered) is provided in the mounting plate 310 to accomodate the drive output shaft 308. The mounting member 310 is transversely situated so that motor 302, speed reducer 304 and spur gear 306 are positioned just below the inlet opening 60 in the end wall 50. (FIG. 8.) In the assembled feed/cut device 26, the drive device 300 is postioned almost directly below the pulling mechanism 102 of the feed device 100 (FIG. 2) and almost directly upstream of the motion-supplying mechanism 204 of the cut device 200 (FIG. 3).

During operation of the cushioning conversion machine 20, the motor 302 of the drive device 300 may be continually running, thereby eliminating the disadvantages and drawbacks associated with non-continuous operation drives. The clutches 134 and 234 (and the brake 238 if used) may then be coordinated to provide alternate engagement to actuate the pulling mechanism 102 and the severing mechanism 202. To this end, the cushioning conversion machine 20 may also include a control system 400 to provide this coordination. The control system 400 could additionally provide some fine-tuning of the clutch engagement timing sequence and/or precautionary checks to prevent jamming and other undesirable situations. For example, a time delay could be provided between the disengagement of the feed clutch 134 and the engagement of the cut clutch 234 (and release of the brake 238, if used) to compensate for any overfeed of the pulling mechanism 102. (The feed device 100 does not include a brake as the pressure between the wheels 118 and 120 is usually sufficient to quickly decelerate their rotation.) Additionally or alternatively, a sensor could be provided to determine the position of the blade carriage 222 and the control system 400 could prevent engagement of the feed clutch 134 and/or the cut clutch 234 unless the blade carriage 222 is in a designated position.

To assemble the feed/cut assembly 26, the feed device 100 and the drive device 300 are first assembled and mounted to the downstream surface of the end wall 50. The cut device 200 is then assembled as a modular unit and the side walls 52 attached to the end wall. The cut device 200 is then dropped between the side walls 52 and its mounting platforms 208 and 210 secured to the side walls. Thereafter, the remaining enclosure walls (54, 56 and 58) can be assembled to complete the second housing section 30.

To assemble and mount the feed device 100, for example, the brackets 108 with the tie members 126 anchored thereto can be attached to the end wall 50. The ends of the shaft 122 (with the pulling wheel 120 previously mounted thereon) can be dropped into the slots 116 in such a manner that the tie members 126 are inserted therethrough. The coil springs 128 can then be dropped around the stem of the tie members 126 and the threaded stops 130 loosely secured thereto. The various components of the motion-supplying mechanism 104 (with the pulling wheel 118 previously fixedly mounted on the shaft 132), can then be assembled and attached to the mounting plates 106. The mounting plates 106 can then be attached to the end wall 50 and the stops 130 retracted on the tie members 126 to properly mesh the wheels 118 and 120.

To assemble and mount the drive device 300, for example, the motor 302, speed reducer 304, and spur gear 306 can be assembled and mounted on the mounting member 310. The mounting member 310 can then be mounted to the end wall 50. The order of mounting between the feed device 100 and the drive device 300 is not believed to make an impact on assembly efficiency. However, it is believed to be most efficient to mount both the feed device 100 and the drive device 300 to the housing end wall 50 prior to attaching the housing side walls 52. To assemble and mount the cut device 200, for example, the guide rods 224 can be inserted through the channels in the carriage 222 (with blade 200 previously secured thereto) and the opposite ends of the guide rods 224 can be attached to the mounting platforms 208 and 210. The stationary blade step 228 (with the blade 226 previously attached thereto) and the tunnel 250 can be mounted on the platform 210. Meanwhile, the crank arms 240 and the components of the motion-supplying mechanism 204 (shaft 230, hubs 232, clutch 234, spur gear 236 and brake 238) can be assembled together and with the mounting plates 212 and 214, and then the mounting plates 212 and 214 can be mounted to the platform 210. Thereafter, the connecting rods 242 can be inserted through the openings in the mounting platform 210 and their opposite ends attached to the crank arms 240 and the blade carriage 222. The completely assembled cut device 200 can then be inserted between the housing side walls 52 and the ends of the mounting platforms 208 and 210 attached thereto.

One may now appreciate that the present invention provides a cushioning conversion machine 20 and related methodology characterized by various features including inter alia, a single drive device for both the feed device and the cut device, reversible clutch arrangements for the feed device and cut device, a cut device braked to avoid inadvertently movement, simplified power transmission, and uncomplicated assembly capabilities.

Although the invention has been shown and described with respect to a preferred embodiment, it will be apparent that equivalent alterations and modifications will occur to others skilled in the art upon the reading and understanding of this specification. Therefore, the present invention includes all such equivalent alterations and modifications.

What is claimed is:

1. A cushioning conversion machine comprising conversion assemblies which convert a sheet stock material into a relatively low density cushioning product;

wherein said conversion assemblies include a feed/cut assembly comprising a feed device, a cut device, and a drive device;

wherein the drive device is operable in two opposite directions;

wherein the cut device comprises a severing mechanism having moving components which sever the stock material and a motion-supplying mechanism which supplies motion to the severing mechanism; and wherein the motion-supplying mechanism comprises a clutch operably coupled to the drive device and which, when engaged, allows the motion-supplying mechanism to provide motion to the severing mechanism in two opposite directions.

2. A cushioning conversion machine as set forth in claim 1, wherein the feed device comprises a pulling mechanism which pulls the stock material and a motion-supplying mechanism which supplies motion to the pulling mechanism and wherein the motion-supplying mechanism comprises a clutch which is operatively coupled to the drive device and which, when engaged, allows the motion-supplying mechanism of the feed device to provide motion to the pulling mechanism in two opposite directions.

3. A method as set forth in claim 2, wherein said step of using the cushioning conversion machine to convert the sheet stock material comprises:

activating the drive device in one of the two opposite directions;

engaging the clutch of the feed device whereby it is operatively coupled to the drive device and motion is supplied to a pulling mechanism in one of two opposite directions to pull the stock material;

disengaging the clutch of the feed device;

engaging the clutch of the cut device whereby it is operatively coupled to the drive device and motion is supplied to the severing mechanism in one of the two opposite directions to sever the stock material.

4. A method as set forth in claim 3, further comprising the steps of:

activating the drive device in the other of the two opposite directions;

engaging either the clutch of the feed device or the clutch of the cut device whereby it is operatively coupled to the drive device and motion is supplied to the pulling mechanism or the severing mechanism in the other of the two opposite directions.

5. A cushioning conversion machine as set forth in claim 1, wherein the motion-supplying mechanism of the cut device further includes a brake which, when in a braked condition, prevents movement of the moving components of the severing mechanism and which, when in a released condition, allows movement of the moving components of the severing mechanism.

6. A cushioning conversion machine as set forth in claim 5, wherein the brake is an electromagnetic brake.

7. A cushioning conversion machine as set forth in claim 5, wherein the motion-supplying mechanism of the cut device further comprises a shaft and wherein the brake prevents rotation of the shaft when in the braked condition and allows rotation of the shaft when in the released condition, said shaft is the rotating shaft to which the cut gear is attached.

8. A cushioning conversion machine as set forth in claim 4, wherein the brake is biased to the braked condition.

9. A cushioning conversion machine as set forth in claim 8, wherein the brake is mechanically biased to the braked condition.

10. A cushioning conversion machine as set forth in claim 1, wherein:

the feed device includes a pulling mechanism having moving components which pull the stock material and a motion-supplying mechanism which supplies motion to the pulling mechanism;

the motion-supplying mechanisms of the feed device and the cut device each have a rotating shaft with a feed gear and a cut gear, respectively, attached thereto; and the drive gear is meshed with both the feed gear and the cut gear to transfer rotational power to both the feed device and the cut device.

11. A cushioning conversion machine as set forth in claim 10, wherein the drive gear, the feed gear, and the cut gear are spur gears.

12. A cushioning conversion machine as set forth in claim 1, further comprising a housing supporting at least some of the conversion assemblies and wherein the feed device and the drive device are mounted to a first wall of the machine's housing and the cut device is mounted to two different walls of the machine's housing.

13. A cushioning conversion machine as set forth in claim 12, wherein the first wall of the housing to which the feed device and drive device are mounted is an end wall and wherein the two different walls to which the cut device is mounted are side walls extending perpendicularly downstream from the end wall.

14. A cushioning conversion machine as set forth in claim 12, wherein the cut device includes two mounting members to which the other components of the cut device are mounted independent of the machine's housing and wherein the two mounting members are attached to and extend between the two different walls of the machine's housing.

15. A cushioning conversion machine as set forth in claim 1, wherein said conversion assemblies further comprise a former assembly which inwardly turns lateral edges of the sheet stock material.

16. A cushioning conversion machine as set forth in claim 1, wherein the clutch of the cut device is an electromagnetic clutch.

17. A cushioning conversion machine as set forth in claim 1, wherein the motion-supplying mechanism of the cut device further comprises a shaft which is operatively coupled to the clutch when the clutch is engaged and wherein the clutch allows the shaft to be rotated in both a clockwise and a counterclockwise direction, said shaft operably coupled to the clutch is the rotating shaft to which the cut gear is attached.

18. A cushioning conversion machine as set forth in claim 17, wherein the severing mechanism comprises a reciprocating carriage on which a blade is mounted and wherein the cut device further comprises a motion-transferring mechanism which changes rotational motion from the shaft of the motion-supplying mechanism of the cut device to reciprocating motion for the carriage of the severing mechanism.

19. A cushioning conversion machine as set forth claim 18, wherein the motion-transferring mechanism of the cut device comprises a pair of crank arms coupled to opposite ends of the rotating shaft of the motion-supplying mechanism of the cut device and opposite ends of the reciprocating carriage of the severing mechanism.

20. A cushioning conversion machine comprising conversion assemblies which convert a sheet stock material into a relatively low density cushioning product;

wherein said conversion assemblies include a feed/cut assembly comprising a feed device, a cut device, and a drive device;

wherein the drive device is operable in two opposite directions;

wherein the feed device comprises a pulling mechanism having moving components which pull the stock material and a motion-supplying mechanism which supplies motion to the pulling mechanism;

wherein the motion-supplying mechanism comprises a clutch which is operatively coupled to the drive device and which, when engaged, allows the motion-supplying mechanism to provide motion to the pulling mechanism in two opposite directions.

21. A cushioning conversion machine as set forth in claim 20, wherein the clutch of the feed device is an electromagnetic clutch.

22. A cushioning conversion machine as set forth in claim 20, wherein the motion-supplying mechanism further comprises a shaft which is operatively coupled to the clutch when the clutch is engaged and wherein the clutch allows the shaft to be rotated in both a clockwise and counterclockwise direction, said shaft operably coupled to the clutch is the rotating shaft to which the feed gear is attached.

23. A cushioning conversion machine as set forth in claim 22, wherein the pulling mechanism includes a pair of loosely meshed wheels and wherein one of the wheels is fixedly mounted on the shaft of the motion-supplying mechanism.

24. A cushioning conversion machine comprising conversion assemblies which convert a sheet stock material into a relatively low density cushioning product;

wherein said conversion assemblies include a feed/cut assembly comprising a feed device, a cut device and a drive device;

wherein the cut device comprises a severing mechanism having moving components which sever the stock material and a motion-supplying mechanism which supplies motion to the moving components of the severing mechanism;

wherein the motion-supplying mechanism is operatively coupled to the drive device;

wherein the motion-supplying mechanism includes a brake which, when in a braked condition, prevents movement of the moving components of the severing mechanism and which, when in a released condition, allows movement of the moving components of the severing mechanism.

25. A cushioning conversion machine comprising conversion assemblies which convert a sheet stock material into a relatively low density cushioning product;

the conversion assemblies including a feed/cut assembly comprising a feed device, a cut device, and a drive device;

the feed device including a pulling mechanism which pulls the stock material and a motion-supplying mechanism which supplies motion to the pulling mechanism;

the cut device including a severing mechanism which cuts the stock material and a motion-supplying mechanism which supplies motion to the severing mechanism;

the drive device including a motor having a rotating output drive shaft with a drive gear attached thereto;

the motion-supplying mechanisms of the feed device and the cut device each having a rotating shaft with a feed gear and a cut gear, respectively, attached thereto;

the drive gear being meshed with both the feed gear and the cut gear to transfer rotational power to both the feed device and the cut device.

26. A cushioning conversion method of converting a sheet stock material into a relatively low density cushioning product, said method comprising the steps of:

supplying the sheet stock material; and using a cushioning conversion machine to convert the sheet stock material into the relatively low cushioning product, the conversion machine including conversion assemblies which convert a sheet stock material into a relatively low density cushioning product, said conversion assemblies include a feed/cut assembly comprising a feed device, a cut device, and a drive device, the drive device being operable in two opposite directions, the cut device including a severing mechanism having moving components which sever the stock material and a motion-supplying mechanism which supplies motion to the severing mechanism, and the motion-supplying mechanism including a clutch operably coupled to the drive device and which, when engaged, allows the motion-supplying mechanism to provide motion to the severing mechanism in two opposite directions.

27. A method as set forth in claim 26, wherein the step of supplying the sheet-like stock material comprises supplying stock material that is biodegradable, recyclable and made from a renewable resource.

28. A method as set forth in claim 27, wherein the stock material is paper.

29. A method as set forth in claim 28, wherein the stock material is multi-ply paper.

30. A method as set forth in claim 28, wherein the stock material is thirty pound Kraft paper.

31. A method as set forth in claim 30, wherein the stock material is approximately 27 inches wide.

32. A method as set forth in claim 26, further comprising the steps of releasing the brake to allow movement of the moving components of the severing mechanism.

33. A cushioning conversion machine comprising conversion assemblies which convert a sheet stock material into a relatively low density cushioning product;

wherein said conversion assemblies include a feed/cut assembly comprising a feed device, a cut device, and a drive device;

wherein the drive device is operably coupled to both the feed device and the cut device and alternately drives the feed device and the cut device.

* * * * *

UNITED STATES PATENT AND TRADEMARK OFFICE

CERTIFICATE OF CORRECTION

PATENT NO. : 6,176,818 B1
DATED : January 23, 2001
INVENTOR(S) : James A. Simmons, et al.

It is certified that error appears in the above-identified patent and that said Letters Patent is hereby corrected as shown below:

Claim 8, column 15,
Line 21, please change "4" to -- 5 --.

Claim 3, column 14,
Line 48, please change "2" to -- 26 --.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*